US008840984B1

(12) United States Patent
Umphlett et al.

(10) Patent No.: US 8,840,984 B1
(45) Date of Patent: Sep. 23, 2014

(54) PRESSURE SENSITIVE ADHESIVE LABEL FOR WET IRREGULAR SURFACES

(71) Applicant: Morgan Adhesives Company, Stow, OH (US)

(72) Inventors: Carol W. Umphlett, Hudson, OH (US); Chris F. Minarik, Cuyahoga Falls, OH (US)

( * ) Notice: Subject to any disclaimer, the term of this patent is extended or adjusted under 35 U.S.C. 154(b) by 36 days.

(21) Appl. No.: 13/875,558

(22) Filed: May 2, 2013

(51) Int. Cl.
*B41M 1/40* (2006.01)
*G09F 3/02* (2006.01)
*G09F 3/10* (2006.01)

(52) U.S. Cl.
CPC .. *G09F 3/10* (2013.01); *G09F 3/02* (2013.01); *G09F 2003/0233* (2013.01); *B41M 1/40* (2013.01)
USPC ..... 428/211.1; 428/32.11; 428/32.39; 428/195.1; 428/355 BL

(58) Field of Classification Search
CPC ..... B41M 1/40; G09F 3/02; G09F 2003/0233
USPC ..... 428/32.11, 32.39, 195.1, 211.1, 355 BL
See application file for complete search history.

(56) References Cited

U.S. PATENT DOCUMENTS

| | | | |
|---|---|---|---|
| 4,547,001 | A | 10/1985 | Stitt |
| 4,889,234 | A | 12/1989 | Sorensen et al. |
| 5,292,713 | A | 3/1994 | Stenzel et al. |
| 5,508,247 | A | 4/1996 | Tran et al. |
| 5,613,942 | A | 3/1997 | Lucast et al. |
| 5,661,099 | A | 8/1997 | Mitchell, Jr. |
| 5,750,192 | A | 5/1998 | Smith |
| 5,773,386 | A | 6/1998 | Langan |
| 6,187,432 | B1 | 2/2001 | Krish et al. |
| 6,270,871 | B1 | 8/2001 | Scholz et al. |
| 6,309,498 | B1 | 10/2001 | Doi |
| 7,060,362 | B2 | 6/2006 | Li et al. |
| 7,413,787 | B2 | 8/2008 | Vetrovec et al. |
| 8,133,342 | B2 | 3/2012 | Karan |
| 2004/0018322 | A1 | 1/2004 | Doi |
| 2006/0062899 | A1 | 3/2006 | Rankin et al. |
| 2008/0016023 | A1 | 1/2008 | Aspinall |
| 2008/0160233 | A1 | 7/2008 | Luther et al. |
| 2012/0064198 | A1 | 3/2012 | Kehres et al. |

FOREIGN PATENT DOCUMENTS

| | | |
|---|---|---|
| EP | 48157 | 3/1982 |
| EP | 91800 | 1/1986 |
| WO | 2006036556 A1 | 4/2006 |

*Primary Examiner* — Bruce H Hess
(74) *Attorney, Agent, or Firm* — Tom J. Hall

(57) ABSTRACT

The present invention relates to improved self-adhesive labels which are suitable far use in adhering to wet surfaces or wet irregularly shaped surfaces such as that found on fruits and vegetables. The self-adhesive label is made of a water absorbent backing layer having opposing sides and a rubber-based pressure sensitive adhesive applied on one side of the backing layer. The adhesive is discontinuously coated as a pattern onto the backing layer to provide areas of the adhesive interspersed with areas which are free of adhesive.

20 Claims, 3 Drawing Sheets

PRESSURE SENSITIVE ADHESIVE LABEL FOR WET IRREGULAR SURFACES

BACKGROUND OF THE INVENTION

The present invention relates to pressure sensitive adhesive labels and more particularly, a label adapted to conform to wet, irregularly shaped surfaces that may include texturing found on the surface of raw fruits and vegetables.

In recent years, it has been deemed desirable to apply labels to identify source, as well as grade or quality of raw fruits and vegetables. For many years, growers and packers have sought to apply labels to individual fruit such as apples, avocados, cantaloupe, grapefruit, melons, kiwifruit, lemons, limes, nectarines, oranges, pears, pineapples, plums, tangerines, and watermelons, and to individual vegetables such as bell peppers, celery, cucumber, onions, potatoes, radishes, and squash. Growers and packers wish to affix a recognizable label to the individual products in order to distinguish them from the products of competitors and provide them with a unique identifying mark. Typical processing of fruits and vegetables includes washing the items after they have been picked and before they are shipped. Conventional labels are designed to adhere to dry, relatively smooth surfaces. The presence of water between the label and the surface of the fruit or vegetable will typically cause adhesion failure. Consequently, before a label is applied to these products, they must be thoroughly dried so that the label will effectively adhere to their surface. No known adhesive label can effectively be used on wet fruit and vegetable surfaces. As a result, there is a need to develop an adhesive label which is suitable for use under wet conditions.

Another shortcoming of conventional labels is that they often do not conform to the surface of irregular surfaced fruits and vegetable such as, for example, cantaloupe, melons, pineapples, tangerines, potatoes, and some squashes. They become easily creased and/or folded because of the planar nature of the label. Therefore, it would be desirable to provide labels which readily adhere to irregularly shaped or curved surfaces of fruit and vegetables.

There is a need in the art for improved labels that address at least some of the above concerns, and other concerns related to manufacture and use of the labels.

SUMMARY OF THE INVENTION

The present invention is concerned with self-adhesive labels which are suitable for use in adhering to a wet surface. The present invention is also concerned with self-adhesive labels suitable for use in adhering to a wet, irregular surface. The self-adhesive label is made of a water absorbent backing layer having opposing sides and a rubber-based pressure sensitive adhesive applied on one side of the backing layer. The adhesive is discontinuously applied as a pattern onto the backing layer to provide areas of the adhesive interspersed with areas of uncoated backing. The areas of the backing layer which are not covered by adhesive can be at most 90 percent of the total available area of the backing layer. It is believed that the areas of uncoated backing layer provide a means for moisture to be absorbed by the backing layer rendering the label flexible and pliable to conform to nonplanar surfaces having irregularities. It is further believed that the passage of water away from the adhesive improves adhesion between label and the target surface.

DETAILED DESCRIPTION OF THE INVENTION

Figure 1:
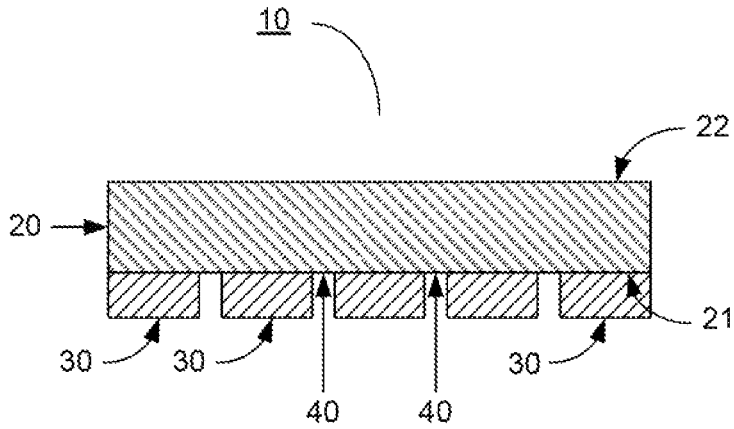
FIG. 1 depicts a cross-sectional view of one embodiment of the present invention.

Referring now more particularly to FIG. 1 of the drawings, a preferred embodiment of label 10 embodying the present invention is shown. The label 10 comprises a water absorbent backing layer 20 having a first surface 21 and an opposing second surface 22. The label 10 further comprises a layer of pressure sensitive adhesive 30. In accordance with an important aspect of the present invention, the pressure sensitive adhesive is applied to the first surface 21 of backing layer 20 in a discontinuous manner so as to provide areas of adhesive interspersed with areas of uncoated backing 40. Application of the adhesive may be accomplished according to techniques known in the art. Such techniques include spray application, roller printing, screen printing and similar single contact techniques. Preferably, the amount of pressure sensitive adhesive 30 applied per unit area of the entire backing layer surface 21 is at least 10 percent of the total available area of the backing layer 20.

Figure 2A:
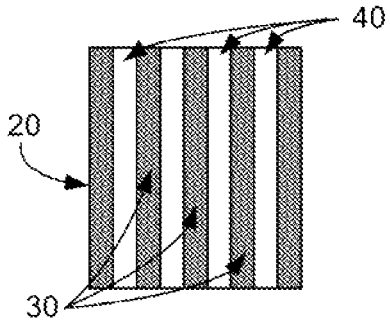
FIG. 2*a*-2*c* depict different embodiments of a discontinuous pattern of adhesive for use in the present invention.
Figure 2B:
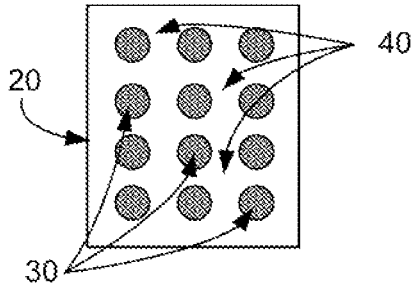
Figure 2C:
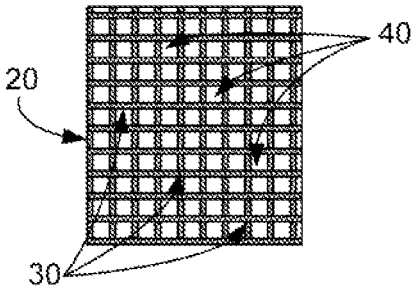

In a preferred embodiment, the amount rubber-based pressure sensitive on the backing layer is between 1.6 and 9.0 grams per 100 square inch, and more preferably, between 3.5 and TO grams per 100 square inch. It is also preferred that the area which is adhesive-free 30 is between 5 percent and 90 percent of the total available area of the backing layer, and even more preferred, between 15 percent and 50 percent of the total available area of the backing layer. As depicted in FIGS. 2*a*-2*c* the pressure sensitive adhesive 30 may be applied to backing layer 20 as a straight strip pattern creating alternating lanes of adhesive 30 and lanes of adhesive-free areas 40. Alternatively, the strip pattern may be formed as curved lines, zigzag lines or combinations thereof (not shown). Alternatively, pressure sensitive adhesive 30 may be applied to backing layer 20 as circular islands of adhesive 30 surrounded by adhesive-free areas 40 as shown in FIG. 2*b*. Alternatively, the islands of adhesive may have the shape of squares, torus, rectangles, or diamonds. In still other embodiments, adhesive 30 may be applied to backing layer 20 in a cross-hatch pattern 2c.

Evaluation of Backing Materials

Various materials were evaluated as a possible backing layer candidates with respect to their flexibility when wet and their water wicking capability. Specimen samples were constructed by coating a synthetic rubber-based pressure sensitive adhesive mixture, MP-735 supplied by Morgan Adhesives Company, Inc., onto a release liner in a strip pattern having a width of approximately 0.0625 inch (0.159 centimeter) similar to that described in FIG. 3 above. After the excess solvent was removed by drying coated release lines, the backing layer candidate material to be tested was then transfer coated onto the adhesive to form a label laminate. A 1-inch diameter circular specimen was die cut from each label laminate. The surface of a fresh cantaloupe was treated with running water for five minutes after which time the circular specimen was immediately applied. Observations were rated on a relative scale of 0 to 5 with respect to how easily the label specimen conformed to the surface of the cantaloupe and how well moisture was absorbed by the specimen. The results are shown in TABLE 1 below.

TABLE 1

Evaluation of Backing Materials

| Material | Coat Weight of Adhesive (g/100 in2) | Thickness of Backing (mil) | Wet Flexibility (Conformability) | Transverse Wicking (Absorptivity) |
|---|---|---|---|---|
| Wet Strength Uncoated Paper | 3.5 | 4.8 | 2 | 4 |
| Matte Litho Paper | 3.5 | 4.7 | 3 | 4 |
| Uncoated Laser Paper | 3.5 | 3.7 | 5 | 5 |
| Semi-Gioss Coated Paper | 3.5 | 3.0 | 4 | 4 |
| Semi-Gioss Coated Paper | 3.5 | 2.5 | 4 | 4 |
| Biaxially Oriented Polypropylene | 3.5 | 2.3 | 2 | 0 |

0 = very poor; 1 = poor; 2 = fair; 3 = good; 4 = very good; and 5 = excellent.

An example of a commercially available uncoated laser type paper includes 50# Laser Layflat II supplied by Domtar. Corporation, Fort Mill, S.C.

An example of a commercially available semi-gloss coated paper includes 60# Sterling Ultra C1S supplied by NewPage Corporation, Miamisburg, Ohio.

In a preferred embodiment, backing layer 20 is formed from paper face stock. The properties that enable backing layer 20 to absorb water are provided in paper face stock having a basis weight of less than 70 pounds per ream as measured in accordance with TAPPI T-410 test method; and/or a thickness of less than 0.0050 inch (121 microns) as measured in accordance with TAPPI T-411 test method. In a more preferred embodiment, backing layer 20 is formed from paper face stock having a basis weight equal to or less than 60 pounds per ream as measured in accordance with TAPPI T-410 test method, a thickness of between 0.0030 inch (72.6 microns) and 0.0048 inch (121.9 micron) as measured in accordance with TAPPI T-411 test method, TAPPI T-410, and T-411 test methods are incorporated herein by reference in their entities.

Pressure Sensitive Adhesive

Various adhesive materials were examined for use in the present invention based on their ability to function as an adhesive even in the presence of large amounts of water. Different types adhesives may be suitable for use in the present invention which may include acrylic-based pressure sensitive adhesives, butyl rubber-based pressure sensitive adhesives, hydrocarbon-based pressure sensitive adhesives, natural rubber-based pressure sensitive adhesives, synthetic rubber-based pressure sensitive adhesives or combinations thereof. Synthetic rubber-based pressure sensitive adhesives may include a styrene-butadiene copolymer (SB), styrene-isoprene copolymer (SI), a styrene-isoprene-styrene copolymer (SIS), freezer-grade hot melt rubber or combinations thereof. Examples of a commercially available acrylic-based pressure sensitive adhesives include AROSET® 383M self-crosslinking acrylic polymer supplied by Ashland Inc., Columbus, Ohio; DURO-TAK™ AH 115 acrylic-rubber hybrid adhesive supplied by Henkel Corporation, Rocky Hill, Conn.; Acronal® N—CR-1139 all temperature acrylic adhesive supplied by BASF Corporation, Charlotte, N.C.; and FLEXCRYL™ LC-18 water-based acrylic adhesive supplied by Ashland Inc., Columbus, Ohio. An example of a commercially available freezer-grade hot melt rubber adhesive includes Themiogrip H2259-01 adhesive supplied by Bostik, Inc, Wauwatosa, Wis.

In one embodiment, the adhesive 30 is a synthetic rubber-based pressure sensitive adhesive mixture comprising a polystyrene-butadiene copolymer and a styrene-isoprene-styrene copolymer and, preferably, a mixture comprising a polystyrene-butadiene copolymer, a styrene-isoprene-styrene copolymer, and an aromatically-modified aliphatic tackifier, and most preferably, a mixture comprising a polystyrene-butadiene copolymer, a styrene-isoprene-styrene copolymer, and an aromatically-modified aliphatic tackifier having a 2-methyl-1-propene comonomer moiety and a 1,3-pentadiene comonomer moiety or an aromatically-modified aliphatic tackifier having a di-cyclopentadiene moiety. Suitable synthetic rubber-based pressure sensitive adhesive mixtures as described above are produced by Morgan Adhesives Company, Inc. Stow. Ohio under the product identifier MP-735, MP-172S, and MP-894S.

Commercially available styrene-isoprene-styrene copolymers are sold under the product family Quintac® by Zeon Chemicals Corporation, Louisville, Ky. Commercially available styrene-butadiene copolymers are sold under the product family name Solprene® by Dynasol Elastomers, Houston, Tex.

Any of the adhesives described above may include a tackifier, plasticizer, antioxidant/thermal stabilizer, solvent and combinations thereof. None of the ingredients described above are limited to any specific commercially available product mentioned herein.

Two different adhesives on two different backing layers were evaluated with respect to their dry adhesion, damp adhesion and wet adhesion on a fresh cantaloupe. Specimen samples were constructed by coating the adhesive candidate material onto a release liner in either a continuous coating of adhesive or a discontinuous strip pattern having a width of approximately 0.0625 inch (0.159 centimeter). The discontinuous pattern coating of adhesive was a straight strip pattern similar to that described in FIG. 3 above. After the excess solvent was removed by drying coated release lines, a backing layer of either a 50# Laser Layflat II supplied by Domtar Corporation, Fort Mill, S.C., or a polypropylene film was then transfer coated onto the adhesive to form a label laminate. A 1-inch diameter circular specimen was die cut from each label laminate. For damp conditions, the cantaloupe was placed under running water for 1 minute then allowed to dry for 5 minutes before applying the specimen label was applied to its surface. For wet conditions, the cantaloupe was placed under running water for 5 minutes then the specimen label was applied to its surface. Observations were rated on a relative scale of 0 to 5 with respect to its adhesive properties. The results are shown in TABLE 2 below.

TABLE 2

Evaluation of Adhesive & Backing Material

| Adhesive | Backing Material | Adhesive coat weight/Patten (grams/100 inch$^2$) | Dry Adhesion | Damp Adhesion | Wet Adhesion |
|---|---|---|---|---|---|
| $A_1$ | $B_1$ | 7.0/$P_1$ | 4 | 2 | 3 |
| $A_1$ | $B_1$ | 7.0/$P_2$ | 5 | 2 | 1 |
| $A_1$ | $B_1$ | 3.5/$P_1$ | 3 | 1 | 2 |
| $A_1$ | $B_1$ | 3.5/$P_2$ | 5 | 2 | 1 |
| $A_1$ | $B_2$ | 7.0/$P_1$ | 4 | 2 | 2 |
| A1 | B2 | 3.5/$P_2$ | 4 | 3 | 0 |
| $A_2$ | $B_1$ | 7.0/$P_2$ | 3 | 0 | 1 |
| $A_2$ | $B_1$ | 7.0/$P_2$ | 3 | 0 | 0 |
| $A_2$ | $B_1$ | 3.5/$P_1$ | 2 | 0 | 0 |
| $A_2$ | $B_1$ | 3.5/$P_2$ | 3 | 0 | 0 |

0 = very poor; 1 = poor; 2 = fair; 3 = good; 4 = very good; and 5 = excellent.

Adhesive $A_1$ was a synthetic rubber-based mixture comprising a polystyrene-butadiene copolymer, a styrene-isoprene-styrene copolymer, and an aromatically-modified aliphatic tackifies having a 2-methyl-1-propene comonomer moiety and a 1,3-pentadiene comonomer moiety.

Adhesive $A_2$ was Aroset 383M, an acrylic adhesive supplied by Ashland Inc., Columbus, Ohio.

Backing layer $B_1$ was Layflat II an uncoated laser type 50# Laser paper, supplied by Domtar Corporation, Fort Mill, S.C.

Backing layer $B_2$ was a 2.3 mil polypropylene film.

Pattern $P_1$ was a discontinuous strip pattern onto the backing layer.

Pattern $P_2$ was a continuous coating onto the backing layer.

Figure 3:
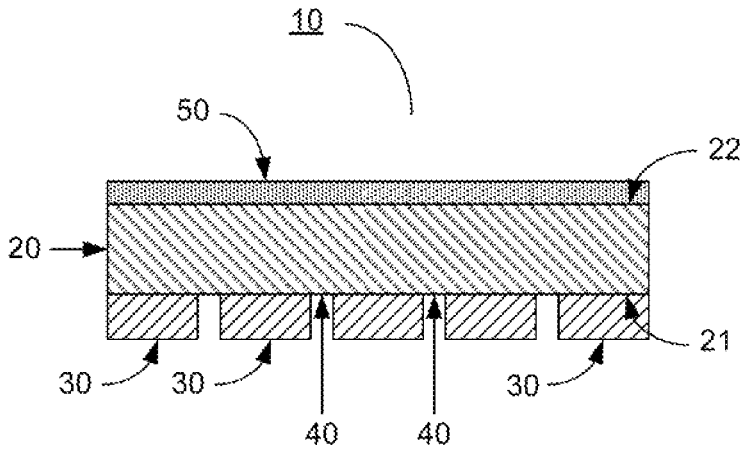
FIG. 3 depicts a cross-sectional of another embodiment of the present invention.

Turning now to FIG. 3, it is further contemplated that label 10 embodying the present invention may further comprise a layer of printed indicia 50 applied to the second surface 22 of backing layer 20. A protective topcoat or primer (not shown) may be provided over printed indicia 50. Layer 50 may be produced by any printing technique known in the art. Specifically, layer 50 may be applied to backing layer 20 using direct thermal printing method. Direct thermal printing is well known in the art and has been described in U.S. Pat. Nos. 5,292,713; 5,508,247; 5,661,099; 5,773,386; and U.S. Patent Application Publication No. 2008/0160233, all of which are incorporated herein by reference in their entireties. Alternatively, layer 50 may be applied to backing layer 20 using thermal transfer printing techniques. Thermal transfer printing methods are well known in the art and have been described U.S. Pat. Nos. 5,292,713; 5,750,192; 6,309,498 and U.S. Patent Application Publication No. 2004/0018322, all of which are incorporated herein by reference in their entireties. Ink jet printing method may also be used to produce layer 50. Ink jet printing is well known in the art and has been described in U.S. Pat. No. 8,133,342 which is incorporated herein by reference.

The following example illustrates a certain particular method of producing a pressure sensitive adhesive label of the present invention and is not to be interpreted as limiting. In the following example, a rubber-based pressure sensitive adhesive is coated onto a 50# super calendared Kraft release liner having a low release platinum cured silicone release system. A modified roll coater is used to apply the adhesive in a 0.0625 inch straight striped pattern onto the release liner. In areas where the coating shim had been cut away, the adhesive stays on the casting roll and returns to the adhesive pan. The adhesive coated release liner is then placed into a forced air oven where excess solvent is removed by heat. After exiting the drying oven, a paper face stock backing layer is laminated onto the surface containing the adhesive coating. The adhesive is now permanently adhered to the backing layer. This laminated product may then be wound onto larger rolls for further processing.

The larger rolls of laminated produce are typically slit down into smaller rolls for easier handling on printing and converting equipment. A solvent flexographic press is used to print indicia onto the outer face of the label web which is then die cut into the finished label. The shape and dimensions of the label may vary. In one embodiment, the label is a circle having a diameter from 0.25 inch to 2 inch. The finished label may then be applied to the fruit or vegetable items by being hand applied, blown onto the item or machine applied.

Alternative methods of coating the adhesive as a pattern onto the release liner or directly onto the backing layer may be used. For example, a die coater utilizing a cut-away shim could be used to coat a solvent-based, an emulsion-based or a hot-melt adhesive into a stripe pattern. Rotogravure printing, nozzles or other methods could also be used to form discontinuous patterns of adhesive onto the backing layer.

The invention claimed is:

1. A self-adhesive label comprising:

a water absorbent backing layer;

a rubber-based pressure sensitive adhesive discontinuously applied as a pattern onto the backing layer to provide areas of adhesive interspersed with adhesive-free areas, wherein the areas which are free of adhesive being at most 90 percent of the total available area of the backing layer;

wherein the label adheres to wet, irregular shaped surfaces.

2. The label of claim 1, wherein the amount rubber-based pressure sensitive on the backing layer is between 1.6 and 9.0 grams per 100 square inch.

3. The label of claim 1, wherein the amount rubber-based pressure sensitive on the backing layer is between 3.5 and 7.0 grams per 100 square inch.

4. The label of claim 1, wherein the area which is free of adhesive is between 5 percent and 90 percent of the total available area of the backing layer.

5. The label of claim 1, wherein the area which is free of adhesive is between 15 percent and 50 percent of the total available area of the backing layer.

6. The label of claim 1, wherein the pattern is strips.

7. The label of claim 1, wherein the rubber-based pressure sensitive adhesive is a synthetic rubber-based pressure sensitive adhesive mixture comprising a polystyrene-butadiene copolymer and either a styrene-isoprene copolymer or a styrene-isoprene-styrene copolymer.

8. The label of claim 1, wherein the rubber-based pressure sensitive adhesive is a synthetic rubber-based pressure sensitive adhesive mixture comprising a polystyrene-butadiene copolymer and a styrene-isoprene-styrene copolymer.

9. The label of claim 1, wherein the rubber-based pressure sensitive adhesive is a synthetic rubber-based pressure sensitive adhesive mixture comprising a polystyrene-butadiene copolymer, a styrene-isoprene-styrene copolymer and an aromatically-modified aliphatic tackifier having a 2-methyl-1-propene comonomer moiety and a 1,3-pentadiene comonomer moiety.

10. The label of claim 1, wherein the backing layer is a paper face stock.

11. The label of claim 1, wherein the backing layer is a paper face stock having a basis weight of less than 70 pounds per ream as measured in accordance with TAPPI T-410 test method.

12. The label of claim 1, wherein the backing layer is a paper face stock having thickness of less than 0.0050 inch (121 microns) as measured in accordance with TAPPI T-411 test method.

13. The label of claim 1, wherein the backing layer is a paper face stock having thickness of between 0.0030 inch (72.6 microns) and 0.0048 inch (121.9 micron) as measured in accordance with TAPPI T-411 test method.

14. The label of claim 1, wherein the backing layer has flexographic printed indicia.

15. The label of claim 1, wherein the backing layer has direct thermal printed indicia.

16. The label of claim 1, wherein the backing layer has thermal transfer printed indicia.

17. The label of claim 1, wherein the backing layer has ink jet printed indicia.

18. The label of claim 1, wherein the label adheres to wet, irregular shaped produce surfaces.

19. A self-adhesive produce label comprising:

a water absorbent paper backing layer having a first surface and an opposing second surface;

a rubber-based pressure sensitive adhesive discontinuously applied onto the first surface of the backing layer as a pattern to provide areas of adhesive interspersed with adhesive-free areas, wherein the areas which are free of adhesive being between about 5 to 90 percent of the total available area of the backing layer;

wherein the pressure sensitive adhesive comprises a mixture of a polystyrene-butadiene copolymer, a styrene-isoprene-styrene copolymer and an aromatically-modified aliphatic tackifier having a 2-methyl-1-propene comonomer moiety and a 1,3-pentadiene comonomer moiety;

a layer of printed indicia applied to the opposing second surface of the backing layer;

wherein the label adheres to wet, irregular shaped produce surfaces.

20. The label of claim 19, wherein the pattern is strips.

* * * * *